US005870942A

United States Patent [19]

Thoma

[11] Patent Number: 5,870,942

[45] Date of Patent: Feb. 16, 1999

[54] SIMPLIFIED HOUSING STRUCTURE FOR A HYDROSTATIC MACHINE

[75] Inventor: Christian Helmut Thoma, Jersey, United Kingdom

[73] Assignee: Unipat Aktiengessellschaft, Glarus, Switzerland

[21] Appl. No.: 902,034

[22] Filed: Jul. 29, 1997

[30] Foreign Application Priority Data

Jul. 29, 1996 [GB] United Kingdom ..... 96158910

[51] Int. Cl.[6] ..... F01B 1/06

[52] U.S. Cl. ..... 92/12.1; 42/58; 42/72

[58] Field of Search ..... 92/12.1, 58, 72

[56] References Cited

U.S. PATENT DOCUMENTS

| | | | |
|---|---|---|---|
| 3,357,362 | 12/1967 | Orr | 92/58 |
| 4,747,339 | 5/1988 | Wusthof et al. | 92/72 X |
| 4,974,496 | 12/1990 | Apgar | 92/58 X |
| 5,081,906 | 1/1992 | Lemaire et al. | 92/58 X |
| 5,400,594 | 3/1995 | Hayens | 92/58 X |
| 5,503,535 | 4/1996 | Thoma et al. . | |
| 5,626,465 | 5/1997 | Thoma . | |

*Primary Examiner*—Hoang Nguyen
*Attorney, Agent, or Firm*—Young & Thompson

[57] ABSTRACT

A housing structure for a hydrostatic machine comprising two shells of part-cylindrical form. The shells are connectable together at their junction surfaces on a parting-plane. A drive-shaft is supported in the housing structure and its axis of rotation lies on the parting-plane, this being the axis of symmetry of the shells. The shells are identical in cast shape, and have symmetrically arranged recesses and surface features to either side of said axis of symmetry. In the interior chamber between the shells, working component elements of the machine are located and driven by the drive-shaft to convert mechanical power into hydraulic power passing through openings or fluid-passageways provided in the housing structure.

16 Claims, 6 Drawing Sheets

SIMPLIFIED HOUSING STRUCTURE FOR A HYDROSTATIC MACHINE

This invention relates to a simplified housing structure for a hydrostatic machine. Whereas prior art hydrostatic machines have employed housings comprising two or more broad cylindrical housing elements or two or more part-cylindrical shells, the present invention teaches the use of two shells of identical cast form. The use of two identical shells to form the complete housing structure for a hydrostatic machine has significant tooling economies, especially with respect to expensive pressure die-casting tools, as only one tool is now required instead of the usual two or three.

This invention has application for hydrostatic pumps or motors or complete hydrostatic transmissions or transaxles. The internal working component elements of the hydrostatic machine may be of the type known as piston, vane, gear or any other suitable type of positive displacement means.

An object of the invention is to provide symmetrical location surfaces in the interior of the shells so that the internal working component elements of the machine can be located and positioned in either or both shells on such surfaces. Preferably, such surfaces are cast as interior detail in the shells to avoid or minimise the need for any secondary machining operations. A further object is to provide such location surfaces in the interior of the shells in a manner whereby the internal working component elements of the machine such as the piston actuation means can be assembled in position in either or two orientations as prime movers such as internal combustion engines and electric motors do not always rotate in the same direction in driving the machine.

From one aspect, the invention consists of a housing structure for surrounding the working component elements of a hydrostatic machine and having provision for a drive-shaft for the transmission of mechanical power which said working component elements convert into hydraulic fluid movement or vice versa; said housing structure comprising first and second shells cast identically in shape and formed with a number of generally semi-circular recesses in the interior of said first and second shells, said first and second shells connectable together along a parting-plane in which the rotating axis of said driveshaft will lie and where said recesses of said first of said shells corresponding with said recesses of said second of said shells to define a number of pockets or apertures to receive said working component elements of said hydrostatic machine.

These and other objects of the invention will now be described in more detail with reference to the accompanying drawings. In terms of teaching the use of the present invention, by way of example, a form of radial piston machine having piston actuation means in the form of a track-ring is here disclosed illustrating how the working elements of a hydrostatic machine would combine with the identical cast shell housing construction.

BRIEF DESCRIPTION OF THE DRAWINGS

The invention may be performed in various ways and one specific embodiment is described by way of example with reference to the accompanying drawings, in which.

BRIEF DESCRIPTION OF THE INVENTION

Figure 1:
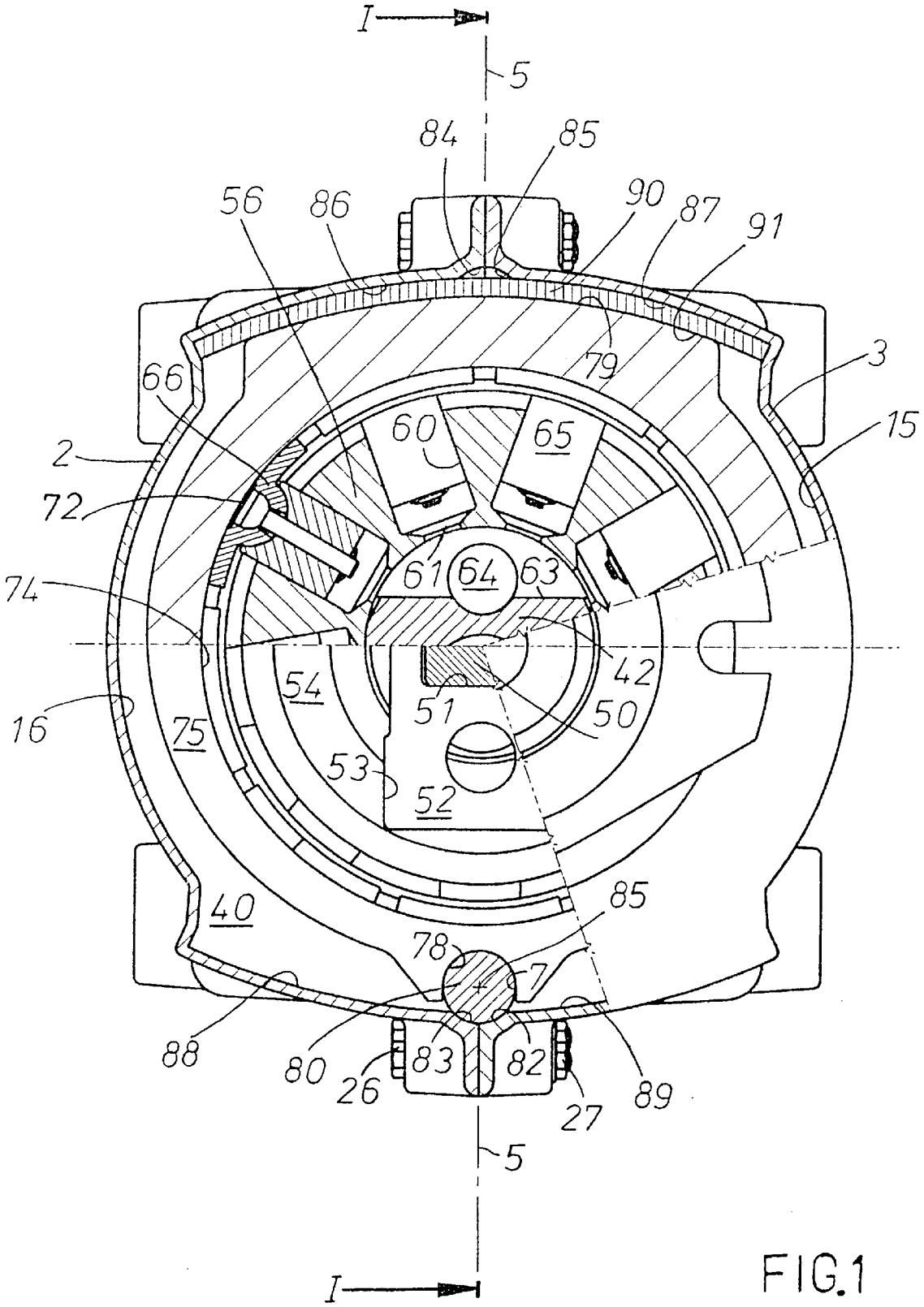
FIG. 1 is a sectional end view of the housing structure for a hydrostatic machine according to the invention.
Figure 2:
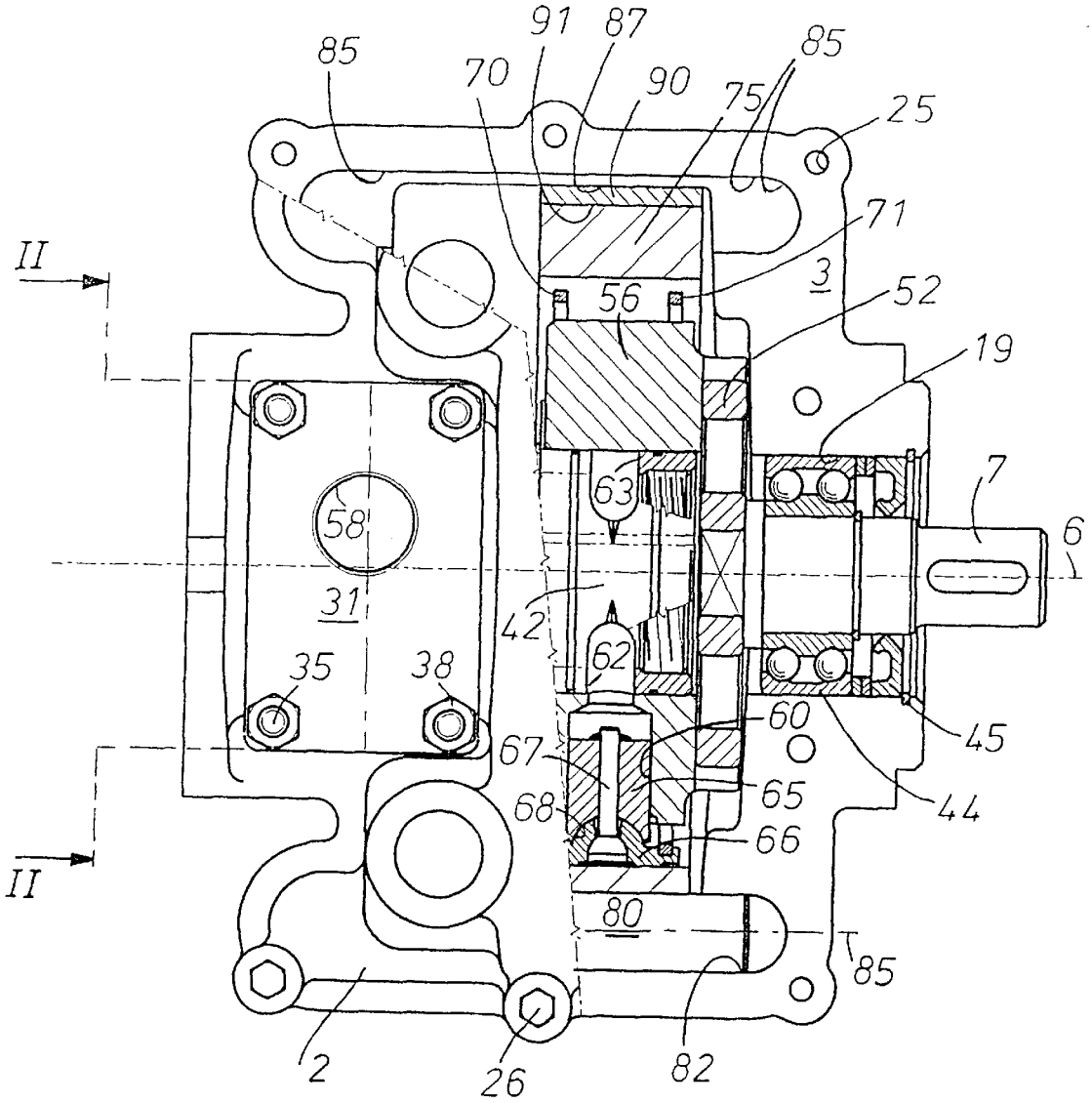
FIG. 2 is a sectional plan view of the machine of FIG. 1 on the line I—I.
Figure 3:
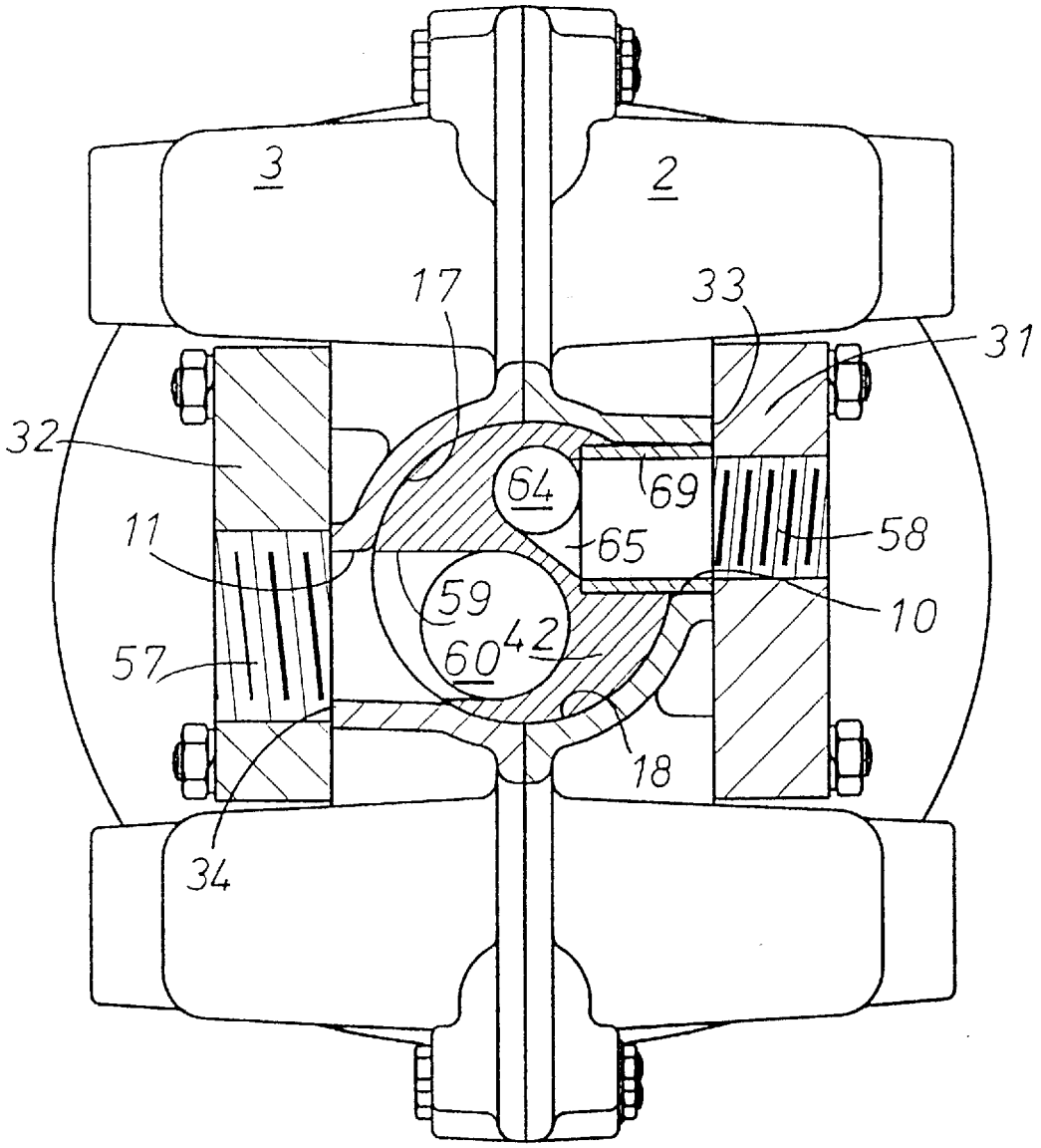
FIG. 3 is a part-sectional rear view of the machine of FIG. 2 on the line II—II.

As shown FIGS. 1—3, an outer housing structure surrounds the inner working component elements of the machine, and where the housing structure comprises respective shells 2, 3. Shells 2, 3 are cast identically and are of partcylindrical form, and they interconnect with each other on a junction surface or interface at the parting-plane as denoted by phantom line 5. The rotating axis of the drive-shaft 7, shown as phantom line 6 lies on the parting-plane 5.

Figure 6:
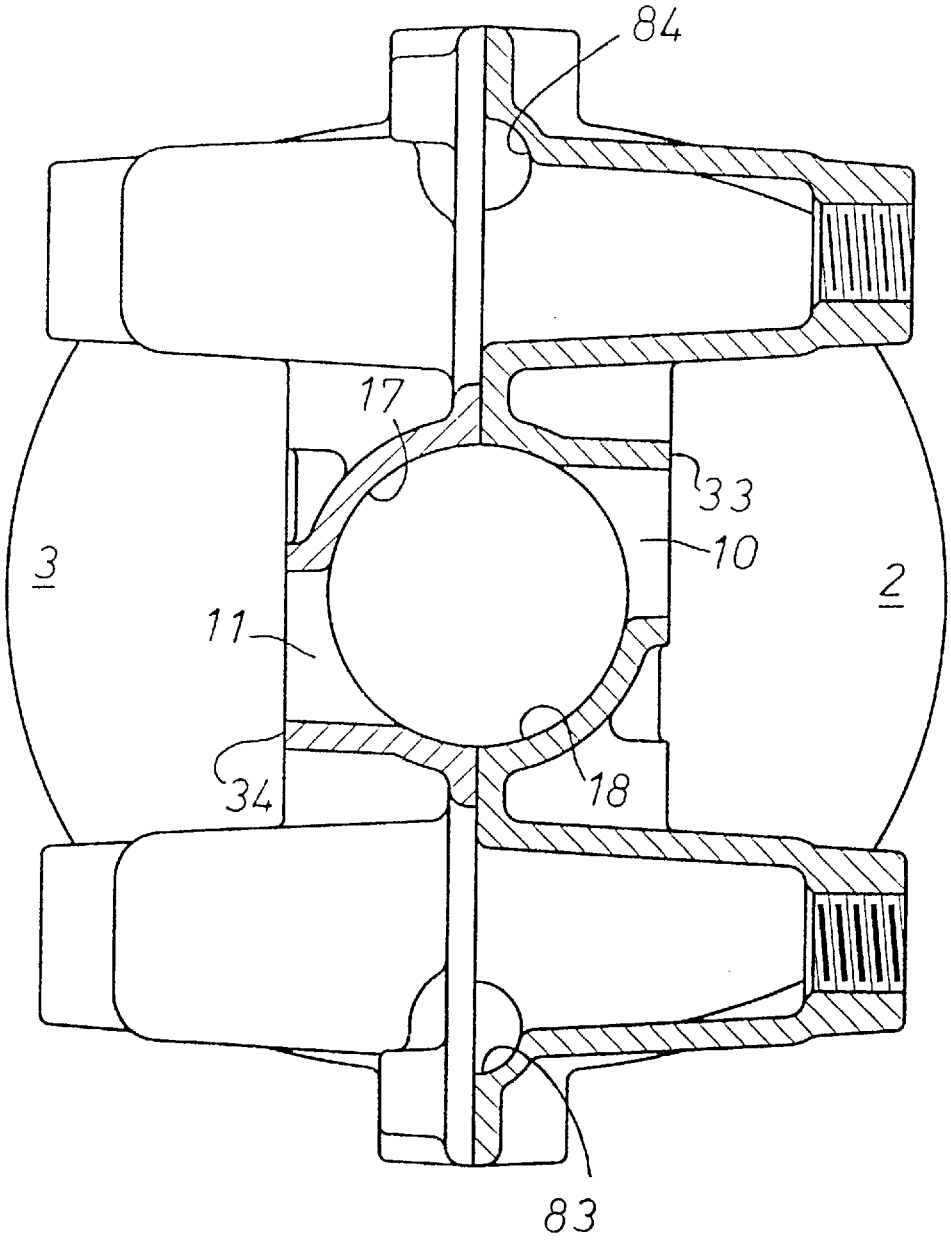
FIG. 6 is a view of the housing structure of FIG. 3 with the internal working components of the machine removed.

Each shell 2, 3 is provided with an opening 10, 11 respectively as shown in FIGS, 3,6, each opening 10, 11 intercommunicating the interior and exterior surfaces of each respective shell 2, 3 together. The longitudinal axes of openings 10, 11 are offset from one another on either side of the parting-plane 5 as shown in FIG. 6, and where openings 10, 11 are the fluid-passageways for the fluid entering and exiting the hydrostatic machine.

Shell 3 is provided with one large semi-circular recess 15 and a number of smaller semi-circular recesses such as those shown as 17, 19, Similarly shell 2 also has identical and equal number of such recesses as shown as 16, 18.

Attachment holes are provided in both shells 2, 3, for instance, holes 25 in shell 3 which correspond with a similar number of holes in shell 2, respective pair of holes 25 being equidistant from the rotational axis 6 of the drive-shaft 7.

Once all the working component elements of the machine have been positioned in place in the interior of shell 3, anaerobic or silicone-sealant is applied over the junction surface. Shell 2 is then lowered onto shell 3 and a number of bolts 26 are inserted through the holes 25 in both shells 2, 3, to be engaged to nuts 27. Fluid flange-elements 31, 32 are then attached to their respective mounting faces 33, 34 provided on the exterior or outer surface of the shells 2, 3, and studs 35 inserted through holes 36 to engage with nuts 38. Once all the nuts 27, 38 have tightened, shells 2, 3 are locked together to form the housing structure of the hydrostatic machine.

Thus, respective recesses in each shell combine to form a number of pockets or apertures. For example, recesses 15, 16 combine to form the main chamber 40 which extends transversely to the parting-plane 5. of the machine. Likewise, recesses 17, 18 combine to form a pocket which supports the pintle-valve 42, and recess 19 in shell 3 combines with the complementary recess (not shown) in shell 2 to support the bearing 44 and seal 45 of the drive-shaft 7. Once the anaerobic sealant has cured, the chamber 40 is sealed from the outer environment surrounding the housing structure.

Chamber 40 extends transversely from the parting-plane for receiving a cylinder-barrel 56 in a location for rotation by the drive-shaft 7; the adjacent portions of the shells 2,3 on one side of the location defining a mounting for the drive-shaft 7 by means of bearing 44, and the adjacent portions of the shells 2, 3 on the other side of the location defining fluid-passageways 10, 11.

DESCRIPTION OF THE INTERNAL WORKING COMPONENTS ELEMENTS

A tongue 50 provided on drive-shaft 7 fits into a corresponding slot 51 provided in an "Oldham" coupling 52. The coupling 52 fits into a slot 53 provided on the end face 54 of the cylinder-barrel 56, and acts to compensate for any inaccuracy that might exist between the respective axes of the drive-shaft 6 and pintle-valve 42.

Chamber 40 extends transversely to the parting-plane 5 for receiving the cylinder-barrel 56 in a location. The location on one side of the chamber 40 defines a mounting surface for the drive-shaft 7, the location on the other side of the chamber 40 defines the position of the openings 10, 11.

Flange-element 32 has a low-pressure admittance passageway 57 whereas flange-element 31 has high pressure discharge passageway 58. Passageway 57 connects through opening 11 in shell 3 to a pintle-slot 59 provided in pintle-valve 42 which intersects with longitudinal bore 60. Longitudinal bore 60 passes along the longitudinal axis of the pintle-valve 42 allowing fluid to reach the arcuate-slot 62. The opposite arcuate-slot 63 intersects with longitudinal bore 64 allowing fluid to exit the machine by passing through the pintle-slot 65 and through the interior of a non-deformable liner-element 69 to reach the discharge passageway 58 in flange-element 31. Both intake and delivery-passageways 57, 58 are threaded to accept a suitable externally fitted fluid-conduit (such as a pipe) which thereby can connect the machine to a hydraulic circuit.

Cylinder-barrel 56 is supported for rotation on pintle-valve 42 and includes a number of cylinder-bores 60 each connected through a respective "necked" cylinder-port 61 to allow fluid distribution between each of the cylinder-bores 60 with respective elongate arcuate-ports 62, 63 formed on the periphery of the pintle-valve 42.

Each cylinder-bore 60 contains a piston 65 which is attached to a respective slipper 66 by means of a rivet 67. Pistons 65 and slippers 66 mate together on a part-spherical socket 68 to allow articulation of the slipper 66 on the piston 65. The slipper 66 may be provided with a hydrostatic bearing 72 on its face, and guidance-rings 70, 71 are provided and serve to keep the slippers 66 in close proximity with the annular surface 74 of the surrounding track-ring 75. The track-ring 75 serves as the piston actuation means in the radial piston type of hydrostatic piston machine.

Track-ring 75 is provided with a slot 78 which connects to guide-means 80. Guide-means 80 is extended past the slot 78 at each end of be held in channels 82, 83 that are provided in each of the shells 3, 2 respectively.

Channels 84, 85 shown is shells 2, 3 respectively, are provided (but not used in this instance) in case that the track-ring is mounted the opposite way in the machine, for instance, when the rotation of drive-shaft 7 is in the reverse direction to the machine as here illustrated and described.

The slot 78 in track-ring 75 can move radially on guide-means 80 determines the position of the eccentric axis 85 on which track-ring 75 pivots in order to change the amount of reciprocating movement of the pistons 65. The track-ring 75 is provided with a radially extended portion which defines a convex shaped part-cylindrical bearing surface 79.

The interior of shell 2 is provided with an arcuate support surface 86 and the interior of shell 3 is provided with arcuate support surface 87, both arcuate shaped surfaces 86, 87 combining across the parting-plane 5 to provide the location surface for an abutment-member 90. An abutment-member is used for resisting the piston forces which cause the piston actuation member, such as a track-ring, to move in the direction of the abutment member. The profile and shape of both arcuate support surfaces 86, 87 being arranged to be substantially transverse to the parting-plane 5, and equidistant-distant from the rotational axis 6 of the drive-shaft 7.

An abutment-member 90 is positioned on the arcuate support surfaces 86, 87, and is provided with a concave part-cylindrical bearing surface 91 that is defined from an arc struck from the eccentric axis 85.

When pressurised fluid is present in arcuate-slot 63, the general direction of the forces from the pistons 65 subjected to pressure results in a small radial movement of the track-ring 75 in a general direction towards the bearing surface 91 of the abutment-member 90. The slot 78 of track-ring 75 moves relative to guide-means 80, and thereby the convex bearing surface 79 can engage with the concave part-cylindrical bearing surface 91 of the abutment-member 90. Because the direction and magnitude of the resultant piston force is constantly fluctuating as the cylinder-barrel rotates, the resulting engagement in contact between the track-ring and abutment-member does not result in seizure but does act to eliminate most of the vibration of the track-ring during operation of the machine.

Arcuate support surfaces 88, 89 shown is shells 2, 3 respectively are provided (but not used in this instance) in case that the track-ring is mounted the opposite way in the machine, for instance, when the rotation of drive-shaft 7 is in the reverse direction to the machine as here illustrated and described.

BRIEF DESCRIPTION OF THE HOUSING SHELLS

Figure 4:
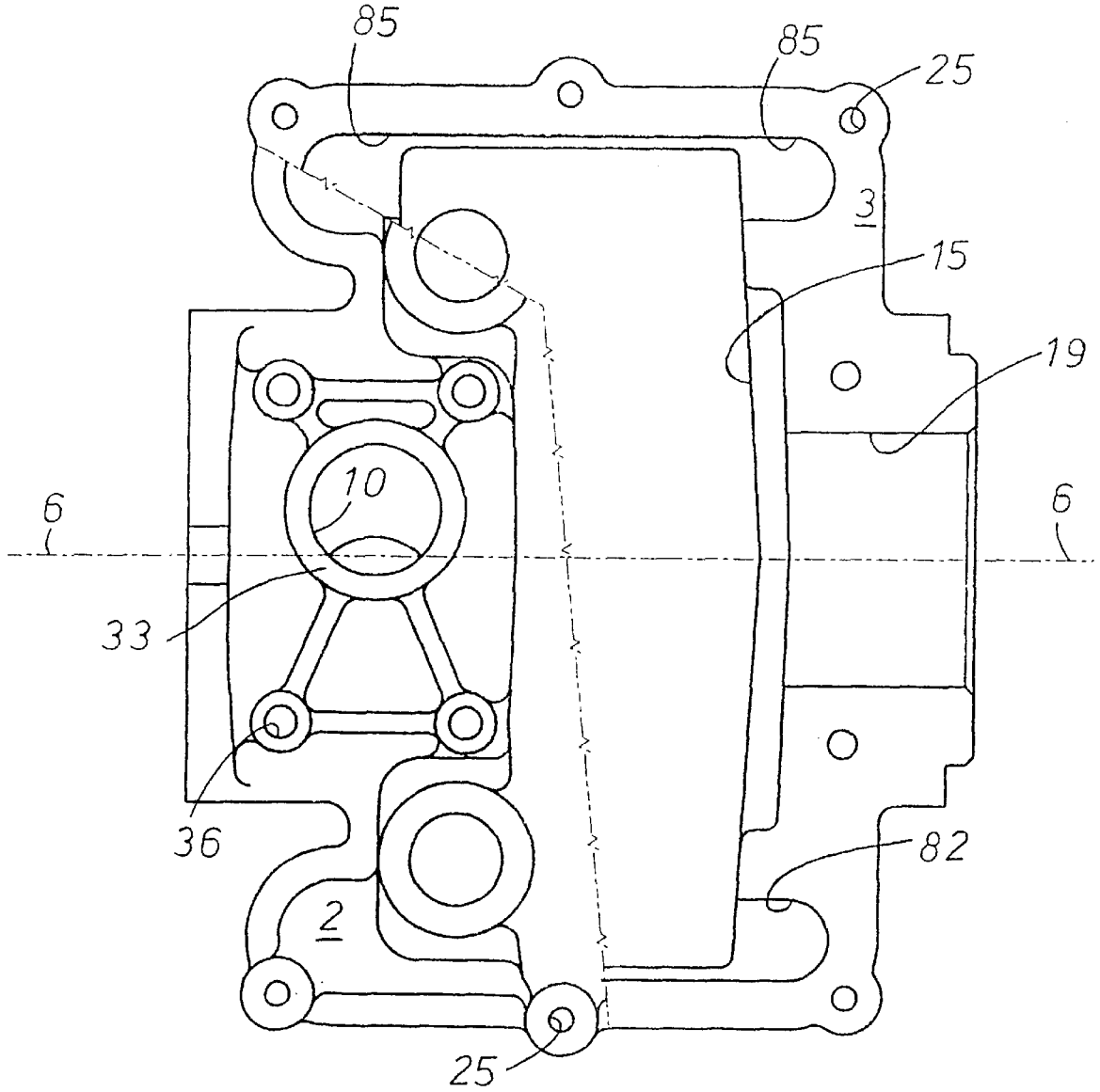
FIG. 4 is a view of the housing structure of FIG. 1 with the internal working components of the machine removed.
Figure 5:
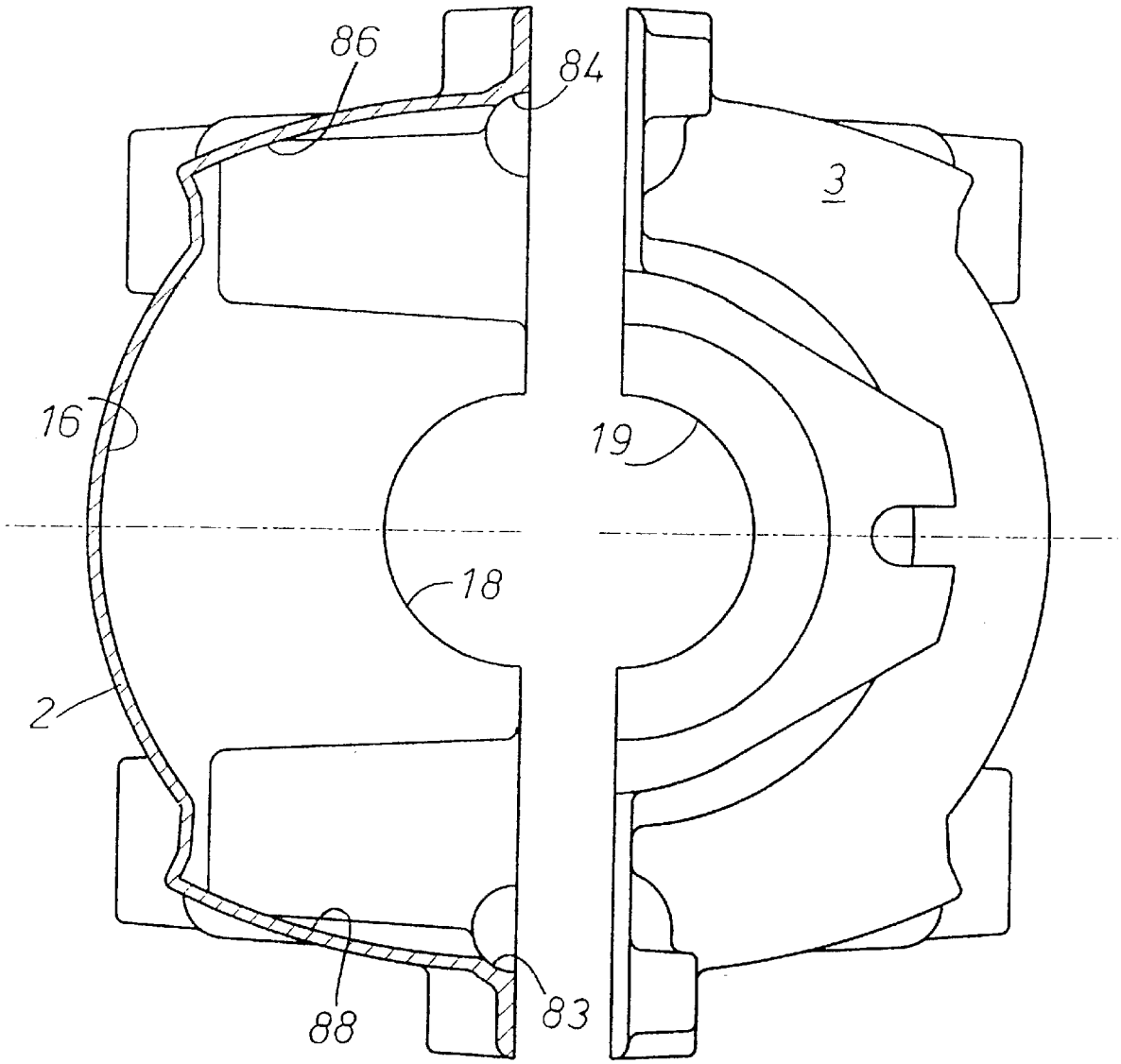
FIG. 5 is a view taken from the right-hand side of FIG. 4 to show top and bottom shells.

The general shape and characteristic of each shell will now be briefly described in more detail with particular reference to FIGS. 4 to 6. FIG. 4 shows part of the exterior surface of shell 2 and in particular, the mounting surface 33 and holes 36 surrounding opening 10. Also shown is portion of the interior detail of shell 3, in particular channels 82, 85. Channel 82, 85 are positioned equidistantdistant from axis 6, and the longitudinal axis of all channels (including channel 83, 84) are in parallel in relationship with axis 6. Also shown is recess 19 for the mounting of the drive-shaft and recess 15 which forms internal chamber 40 when the two shells are combined.

FIG. 5 shows shells 2, 3 in their separate condition. Shell 3 shows the exterior surface whereas Shell 2 is a sectional view to shown the arcuate support surfaces 86, 88 onto which the abutment-member 90 may be located to either surface. Also shown are channels 83, 84.

FIG. 6 shows shells 2, 3 is their combined state and the offset positioning between the longitudinal axes of respective openings 10, 11. Recesses 17, 18 are combined to form the pocket for support of the pintle-valve. As shown, respective openings connect the interior with the exterior of each shells.

As each shell is the mirror image of the other, the invention has the advantage that the track-ring, guide-member and abutment-member can be assembled into the housing structure of the machine in either one of the two orientations. Grooves in the form of sunken channels or the like formed in the interior of the shells may be used in place of the arcuate support surface.

OPERATION OF THE MACHINE

Rotation of the drive-shaft 7 causes the cylinder-barrel 56 to rotate. When the track-ring 75 is placed in an eccentric relationship with respect to the pintle-valve 42, outward sliding movement of the pistons 65 in their respective cylinders 60 occurs. Fluid from some external source, such as a hydraulic reservoir, is drawn in through the low-pressure fluid admittance passageway 57 and passes through opening 11, pintle-port 59, longitudinal bore 60, arcuate-port 62 to the interior of the cylinder-bore 60 via "necked" cylinder-port 61. As the pistons 65 returns inwards in their respective cylinder-bores 60, fluid is displaced through the "necked" cylinder-port 61 into the opposite arcuate-port 63 from where it is directed along the longitudinal bore 64, pintle-slot 65, through non-deformnable liner-element 69 to reach the high-pressure fluid discharge passageway 58 from where it may be piped to service a hydraulic circuit, such as a hydraulic motor. Although not shown, the mechanism used to change the eccentric position of the track-ring, and hence the rate of fluid movement through the machine, may be manual, mechanical or hydraulically operated. The machine may also operate in reverse by the action of incoming pressurised fluid which causes rotation of the drive-shaft.

In accordance with the patent statutes, I have described the principles of construction and operation of my invention, and while I have endeavoured to set forth the best embodiment thereof, I desire to have it understood that obvious changes may be made within the scope of the following claims without departing from the spirit of my invention.

I claim:

1. A housing structure for surrounding the working component elements of a hydrostatic machine and having provision for a drive-shaft for the transmission of mechanical power which said working component elements convert into hydraulic fluid movement or vice versa; said housing structure comprising first and second shells formed with a number of generally semi-circular recesses in the interior of said first and second shells, said first and second shells being connectable together along a parting-plane in which the rotating axis of said drive-shaft will lie and wherein said recesses of said first of said shells combine with said recesses of said second of said shells to define a number of pockets or apertures to receive said working components elements of said hydrostatic machine, wherein one of said working component elements is a cylinder-barrel, and wherein one of said pockets or apertures defines a chamber extending transversely to said parting-plane for receiving said cylinder-barrel in a location for rotation by said drive-shaft, the adjacent portions of said first and second shells on one side of said location defining a mounting for said drive-shaft and the adjacent portions of said first and second shells on the other side of said location defining fluid-passageways for fluid distribution of the moving hydraulic fluid, wherein said fluid-passageways are so arranged as to allow communication between the interior and the exterior of each of the said shells respectively, and wherein the longitudinal axis of the fluid-passageway in said first of said shells is offset in position from the longitudinal axis of the fluid-passageway in said second of said shells when said first and second shells are in a combined state.

2. A housing structure according to claim 1 wherein an externally located fluid-flange element is disposed to the exterior of each said shell respectively, each said fluid-flange element being positioned adjacent to one of said fluid-passageways in said shells respectively to allow fluid communication with said machine.

3. A housing structure according to claim 1 wherein said cylinder-barrel is provided with a number of cylinders, each said cylinder supporting a piston and each said piston being operatively connected to a piston actuating member, said housing structure providing means for the assembly of said piston actuation member in either one of two possible orientations to suit the direction of rotation of said drive-shaft.

4. A housing structure according to claim 1 wherein said cylinder-barrel is provided with a number of radially arranged cylinders, each said cylinder supporting a piston and each said piston being operatively connected to a surrounding annular track-ring, said housing structure providing means for the assembly of said track-ring in either one of two possible orientations to suit the direction of rotation of said drive-shaft.

5. A housing structure according to claim 1 wherein the interior of said first an second shells are each provided with first and second arcuate support surfaces spaced equidistant from the rotating axis of said drive-shaft and substantially transverse to the rotating axis of said drive-shaft; and where said first of said arcuate support surfaces in said first of said shells combines with said second of said arcuate support surfaces in said second of said shells to provide a location surface for an abutment-member.

6. A housing structure according to claim 5 wherein the interior of said first and second shells are each provided with first and second channels spaced equidistant from the rotating axis of said drive-shaft; the longitudinal axes of said channels lying adjacent to said parting-plane and where said first of said channels in said first of said shells combines with said second of said channels in said second of said shells to provide a location for guide-means about which pivotal movement of a piston actuating member can occur.

7. A housing structure according to claim 1 wherein said first and second shells are castable from the same mould.

8. A housing structure for surrounding the working component elements of a hydrostatic machine and having provision for a drive-shaft for the transmission of mechanical power which said working component elements convert into hydraulic fluid movement or vice versa, said housing structure comprising first and second shells and defining a number of generally semi-circular recesses in the interior of said first and second shells, said first and second shells being connectable together along a parting-plane in which the rotating axis of said drive-shaft will lie and wherein complementary pairs of said recesses in said first and second shells combine to define a number of pockets or apertures to receive said working component elements of said hydrostatic machine, wherein one of said working component elements is a cylinder-barrel, and wherein one of said pockets or apertures defines a chamber extending transversely to said parting-plane for receiving said cylinder-barrel in a location for rotation by said drive-shaft, the adjacent portions of said first and second shells on one side of said location defining a mounting for said drive-shaft and the adjacent portions of said first and second shells on the other side of said location defining fluid-passageways for fluid distribution of the moving hydraulic fluid, wherein said fluid-passageways are so arranged as to allow communication between the interior and the exterior of each of said shells respectively, and wherein the longitudinal axis of the fluid-passageway in said first of said shells is offset in position from the longitudinal axis of the fluid-passageway in said second of said shells when said first and second shells are in a combined state.

9. A housing structure according to claim 8 wherein an externally located fluid-flange element is disposed to the exterior of each said shell respectively, each said fluid-flange element being positioned adjacent to one of said fluid-passageways in said shells respectively to allow fluid communication with said machine.

10. A housing structure according to claim 8 wherein said first and second shells are castable from the same mould.

11. A housing structure according to claim 8 wherein said cylinder-barrel is provided with a number of cylinders, each said cylinder supporting a piston and each said piston being operatively connected to a piston actuating member, said housing structure providing means for the assembly of said piston actuation member in either one of two possible orientations to suit the direction of rotation of said drive-shaft.

12. A housing structure according to claim 8 wherein said cylinder-barrel is provided with a number of radially arranged cylinders, each said cylinder supporting a piston and each said piston being operatively connected to a surrounding annular track-ring, said housing structure providing means for the assembly of said track-ring in either one of two possible orientations to suit the direction of rotation of said drive-shaft.

13. A housing structure according to claim 8 wherein the interior of said first and second shells are each provided with first and second arcuate support surfaces spaced equidistant from the rotating axis of said drive-shaft and substantially transverse to the rotating axis of said drive-shaft; and where said first of said arcuate support surfaces in said first of said shells combines with said second of said arcuate support surfaces in said second of said shells to provide a location surface for an abutment-member.

14. A housing structure according to claim 13 wherein the interior of said first and second shells are each provided with first and second channels spaced equidistant from the rotating axis of said drive-shaft; the longitudinal axes of said channels lying adjacent to said parting-plane and where said first of said channels in said first of said shells combines with said second of said channels in said second of said shells to provide a location for guide-means about which pivotal movement of a piston actuating member can occur.

15. A housing structure for a hydrostatic machine comprising first and second housing shells, the first housing shell being manufactured as an aluminium alloy pressure die-casting having an inner surface and an outer surface and wherein an opening communicates between said inner surface and said outer surface, a junction surface disposed to surround said inner surface and defining a plane, said inner surface being sunken from said junction surface in broadly semi-circular fashion as defined by a longitudinal axis lying coincident with said plane, a plurality of holes formed on said junction surface and wherein respective pairs of said holes are positioned equidistant from said longitudinal axis, the second housing shell being manufactured as an aluminium alloy pressure die-casting having an inner surface and an outer surface and wherein an opening communicates between said inner surface and said outer surface, a junction surface disposed to surround said inner surface and defining a plane, said inner surface being sunken from said junction surface in broadly semi-circular fashion as defined by a longitudinal axis lying coincident with said plane, a plurality of holes formed on said junction surface and wherein respective pairs of said holes are positioned equidistant from said longitudinal axis; and wherein both said first and second housing shells are of identical shape and form such that said first housing shell once combined with said second housing shell on their respective junction surfaces creates an internal chamber in which are located working component elements of said hydrostatic machine and wherein said opening in said first housing shell is offset in position from said opening in said second housing shell; and wherein bolts inserted through said holes in both said first and second housing shells act to hold and lock said first and second housing shells together in their combined state.

16. A housing structure according to claim 15 wherein said first and second housing shells are castable from the same mold.

* * * * *